US011453987B2

(12) United States Patent
Philpott et al.

(10) Patent No.: US 11,453,987 B2
(45) Date of Patent: Sep. 27, 2022

(54) MOVABLE BARRIER FOR WALKWAY

(71) Applicant: Universal City Studios LLC, Universal City, CA (US)

(72) Inventors: Aaron Christopher Philpott, Winter Garden, FL (US); Reginald Benjamin Lovelace, Stuart, FL (US); Scott Linley Olson, Hobe Sound, FL (US); Zachary Paul Pfeiffer, Palm Beach Gardens, FL (US)

(73) Assignee: Universal City Studios LLC, Universal City, CA (US)

( * ) Notice: Subject to any disclaimer, the term of this patent is extended or adjusted under 35 U.S.C. 154(b) by 783 days.

(21) Appl. No.: 16/428,636

(22) Filed: May 31, 2019

(65) Prior Publication Data

US 2019/0368142 A1 Dec. 5, 2019

Related U.S. Application Data

(60) Provisional application No. 62/678,772, filed on May 31, 2018.

(51) Int. Cl.

| | |
|---|---|
| ***E01F 13/04*** | (2006.01) |
| ***B61B 1/02*** | (2006.01) |
| ***E01F 13/02*** | (2006.01) |

(52) U.S. Cl.

CPC ..... *E01F 13/048* (2013.01); *B61B 1/02* (2013.01); *E01F 13/022* (2013.01)

(58) Field of Classification Search

CPC ..... E01F 13/048; E01F 13/022; B61B 1/02; E01C 15/00

See application file for complete search history.

(56) References Cited

U.S. PATENT DOCUMENTS

| | | | | |
|---|---|---|---|---|
| 4,517,698 | A * | 5/1985 | Lamp'l | B64F 1/324 14/72.5 |
| 8,661,740 | B2 | 3/2014 | Lin | |
| 9,481,314 | B2 | 11/2016 | Levi | |
| 10,844,576 | B2 * | 11/2020 | Magnussen | E06C 5/02 |
| 2007/0278350 | A1 * | 12/2007 | Gonzalez Linero | B64C 1/24 244/137.1 |
| 2010/0078291 | A1 * | 4/2010 | Fritsche | B66B 21/10 198/324 |
| 2010/0327118 | A1 * | 12/2010 | Gonzalez Linero | B64C 1/24 52/183 |
| 2017/0313255 | A1 | 11/2017 | Brett et al. | |
| 2018/0002139 | A1 | 1/2018 | Stepp et al. | |
| 2018/0272951 | A1 * | 9/2018 | Oliver | B60R 3/005 |

* cited by examiner

*Primary Examiner* — Russell Frejd
(74) *Attorney, Agent, or Firm* — Fletcher Yoder, P.C

(57) ABSTRACT

Embodiments of the present disclosure are directed to an attraction system that includes a walkway, a carrier disposed at a first side of the walkway, and a barrier disposed at a second side of the walkway opposite the first side. The carrier is configured to translate relative to the walkway, and the barrier is removably coupled to the carrier. Translation of the carrier relative to the walkway transitions the barrier between a stowed configuration and a deployed configuration.

20 Claims, 13 Drawing Sheets

MOVABLE BARRIER FOR WALKWAY

CROSS REFERENCE TO RELATED APPLICATIONS

This application claims priority from and the benefit of U.S. Provisional Application Ser. No. 62/678,772, entitled "GUIDE RAIL SYSTEM WITH SLIDING BARRIER FOR WALKWAY," filed May 31, 2018, which is hereby incorporated by reference in its entirety for all purposes.

BACKGROUND

The disclosure relates generally to amusement park entertainment systems and, more specifically, to a walkway of an amusement park attraction.

This section is intended to introduce the reader to various aspects of art that may be related to various aspects of the present disclosure. This discussion is believed to be helpful in providing the reader with background information to facilitate a better understanding of the various aspects of the present disclosure. Accordingly, it should be understood that these statements are to be read in this light and not as admissions of prior art.

An amusement park generally includes a variety of features that each provides a unique experience to guests of the amusement park. For example, the amusement park may include different attraction systems, such as a roller coaster, a drop tower, a log flume, and so forth. Some attraction systems may have a walkway that allows guests to navigate through particular areas of the attraction system, such as to enter and exit the attraction system, and/or to certain areas of interest within the attraction system. However, adjusting a configuration of the walkway, such as to enable greater navigation through the attraction system, may be difficult.

Further, certain attraction systems may include walkways that are generally closed to guests, but allow operators or technicians to control or service parts of the attraction. One example of such a walkway would include a walkway that is adjacent to a track of a roller coaster. A ride operator may walk adjacent to the track, for example to perform regular maintenance. Accordingly, it is now recognized that it is desirable to provide enhanced walkway features to allow the ride operators greater access to various portions of an attraction system.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an attraction system includes a walkway, a carrier disposed at a first side of the walkway, and a barrier disposed at a second side of the walkway opposite the first side. The carrier is configured to translate relative to the walkway, and the barrier is removably coupled to the carrier. Translation of the carrier relative to the walkway transitions the barrier between a stowed configuration and a deployed configuration.

In an embodiment, a barrier for a walkway includes an extension having an opening, a rod disposed within the extension and coupled to a housing, and a latch coupled to the housing and configured to extend through the opening, in which the rod is configured to move relative to the extension to move the latch relative to the opening.

In an embodiment, an attraction system includes a walkway, a carrier configured to translate relative to the walkway and having a receptacle, and a barrier having an extension configured to insert into the receptacle to removably couple the barrier to the carrier. The barrier includes a latch configured to extend through an opening of the extension, and the carrier is configured to translate relative to the walkway to transition the barrier between a stowed configuration and a deployed configuration.

DRAWINGS

These and other features, aspects, and advantages of the present disclosure will become better understood when the following detailed description is read with reference to the accompanying drawings in which like characters represent like parts throughout the drawings, wherein.

Figure 12:
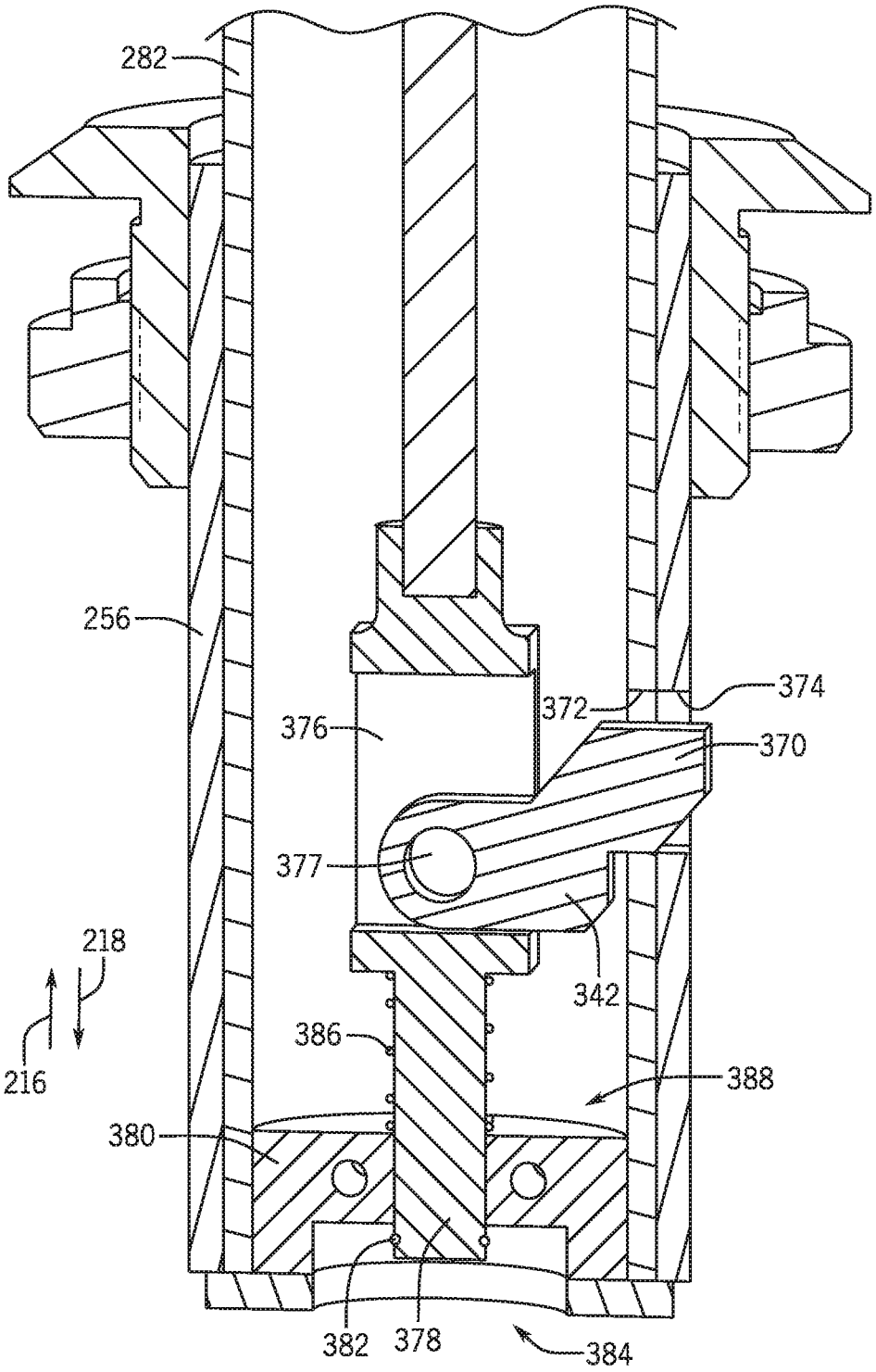
Figure 13:
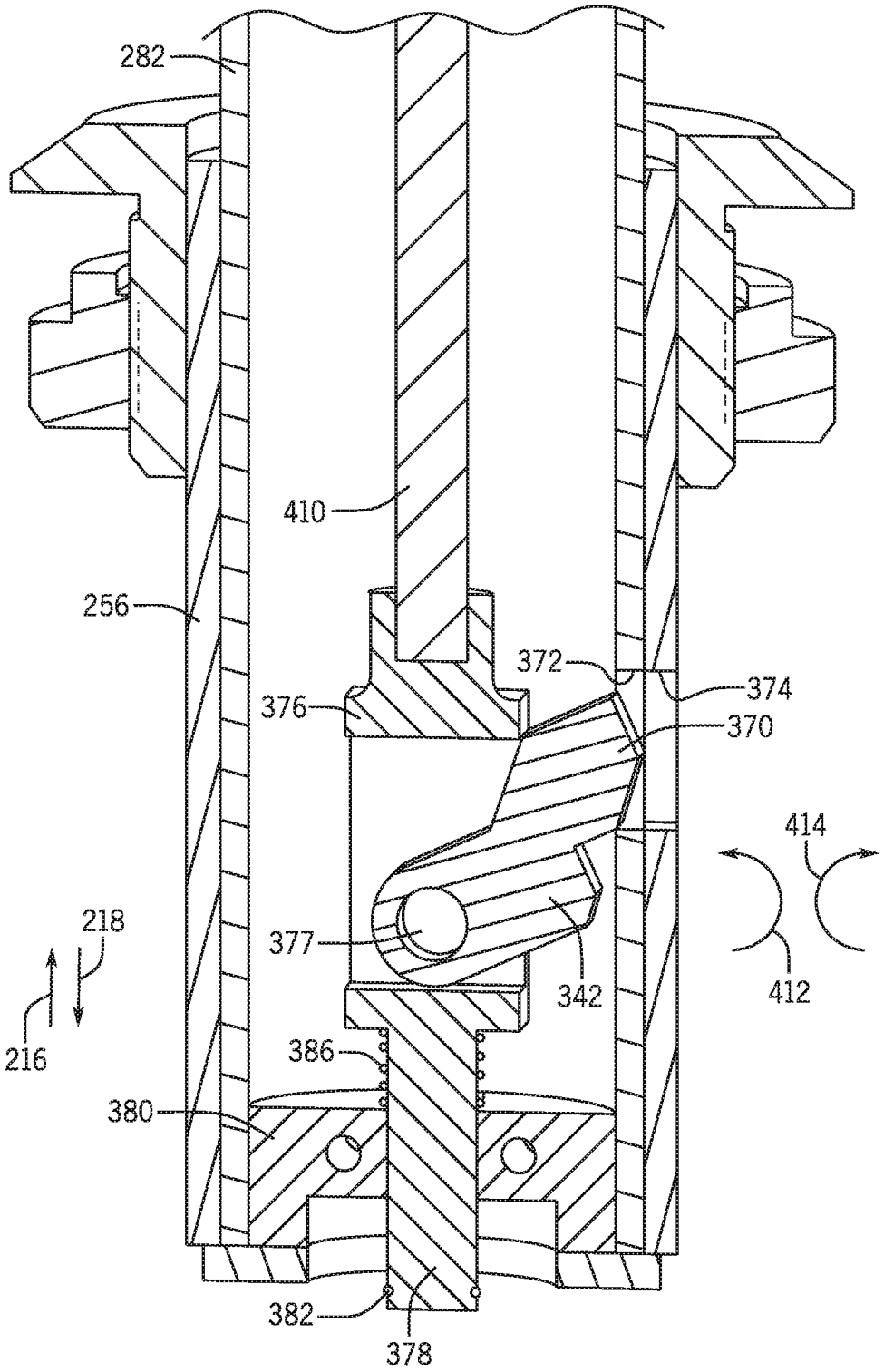

FIG. 12 is a partial cross-sectional side view of an embodiment of an extension of the movable barrier inserted into a receptacle of a walkway or carrier, in which the movable barrier is in an engaged configuration with the receptacle, in accordance with an aspect of the present disclosure; and FIG. 13 is a partial cross-sectional side view of the extension of FIG. 12 inserted into the receptacle, in which the movable barrier is in a disengaged configuration with the receptacle, in accordance with an aspect of the present disclosure.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to a walkway that may be employed in an attraction system of an amusement park. Guests or operators of the amusement park may use the walkway to navigate to particular areas of interest. For example, the attraction system may include a ride vehicle, which may carry the guests and travel a designated path of the attraction system to entertain the guests. The walkway may guide the guests to the ride vehicle, such as from an entrance of the attraction system, and/or may guide guests away from the ride vehicle, such as toward an exit of the attraction system. As another example, the walkway may allow an operator (e.g., a park employee) to access portions of the attraction system for servicing (e.g., portions of the attraction system otherwise closed to guests or having limited use or visibility).

In a certain embodiment, the walkway may include barriers for guidance, among other reasons. In some circumstances, it may be desirable to allow guests or operators to navigate off the walkway. Navigation on and off the walkway may allow transition between the walkway and other areas, such as a ride vehicle that is positioned proximate to the walkway, a staging area, or the like. Permanent barriers may block access off the walkway, and may also be costly and visually undesirable—particularly in situations in which the barrier might detract from the visual experience of guests.

As such, it is now recognized that there is a need for at least a portion of the barriers to be adjustable such that the barriers allow navigation on and off the walkway in a manner that allows multiple configurations, while also causing minimum visual distraction for guests of the attraction. To address these or other needs, in accordance with embodiments of the present disclosure, a movable barrier may be designed (e.g., structurally configured) to transition between a deployed configuration and a stowed configuration on a walkway. In the deployed configuration, the movable barrier may be oriented to block navigation (e.g., by guests and/or operators) off the walkway. In the stowed configuration, the movable barrier may expose a side of the walkway to allow navigation on and/or off the walkway, such as to transition between the walkway and a ride vehicle or other area. In one embodiment, the movable barrier may translate (e.g., linearly translate) to transition between the deployed configuration and the stowed configuration. For instance, in a certain embodiment, the movable barrier and walkway may be configured to couple with one another in a manner that allows the movable barrier to be moved (e.g., slid) along the walkway.

In its stowed configuration, the position of the movable barrier may be set as not interfere with or otherwise limit navigation along the walkway. To allow for deployment in a variety of configurations, in a certain embodiment, the barriers may be manually adjustable. In other words, the barriers may be adjusted by a user, such as an operator, of the attraction system without the use of controllers or other electrical equipment, and without the use of special tools. Thus, an embodiment of the movable barrier in accordance with the present disclosure may not consume electricity, may allow deployment in a variety of settings, and may require less maintenance compared to an electronically-controlled system. However, the present disclosure does encompass an embodiment in which the movable barrier is actuated or otherwise controlled electronically, for example by a controller or a control system (e.g., ride control system).

The movable barrier and associated walkway embodiments presented herein may be used in a variety of settings and locations to address a variety of needs and for many purposes. Thus, while the embodiments set forth herein are presented in the context of an amusement park having attraction systems that utilize such embodiments to address problems or needs that may be particular to the amusement park industry, it is contemplated that the embodiments described herein may be used to solve other problems and address other needs in other fields.

Figure 1:
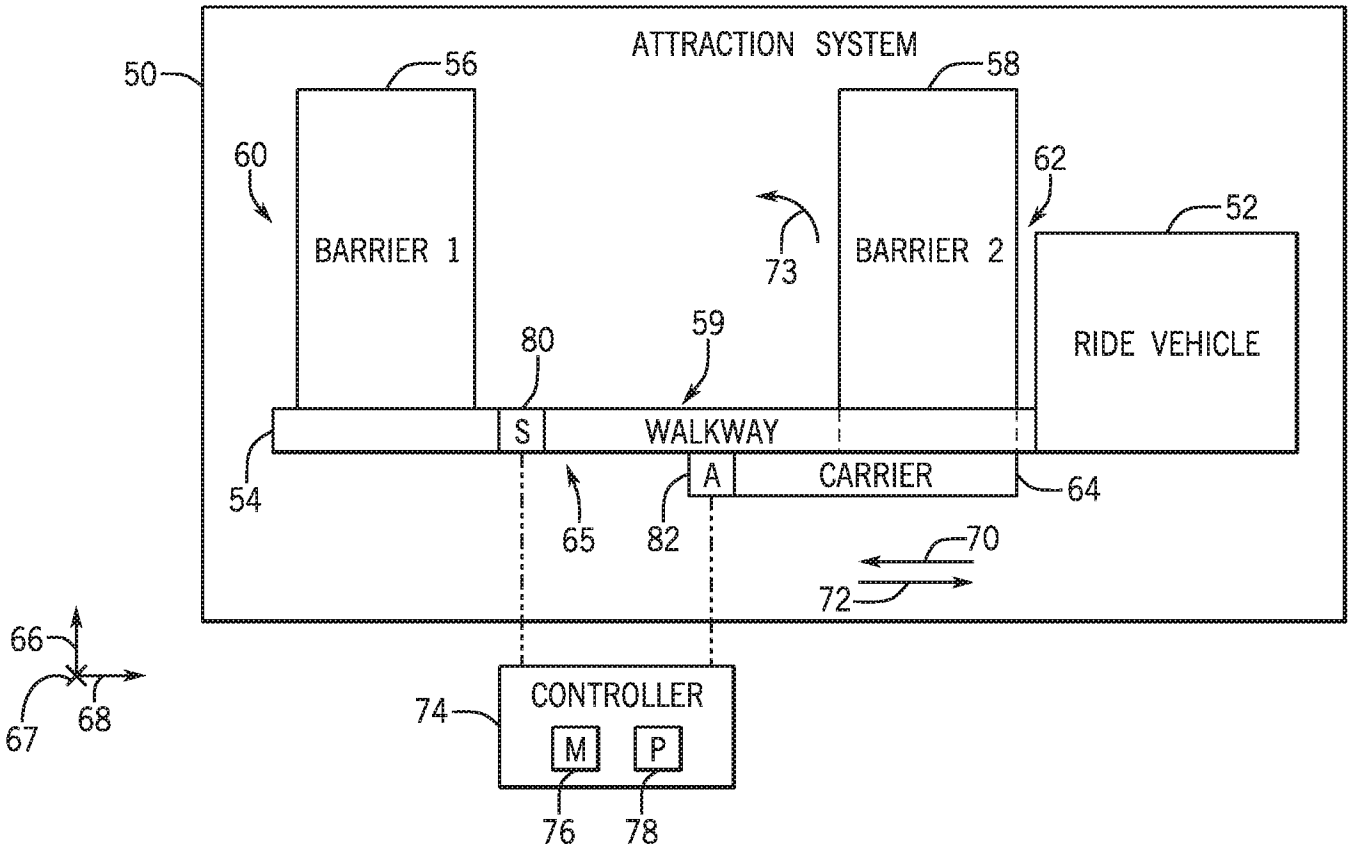
FIG. 1 is a block diagram of an embodiment of an attraction system of an amusement park having a walkway with a movable barrier, in accordance with an aspect of the present disclosure.

Turning now to the drawings, FIG. 1 is a block diagram of an embodiment of an attraction system 50 of an amusement park. The attraction system 50 may include a ride vehicle 52 that guests of the amusement park may enter. The ride vehicle 52 may travel through the attraction system 50 to entertain the guests. For example, the attraction system 50 may be a roller coaster ride and the ride vehicle 52 may be a roller coaster train configured to travel along a ride vehicle path of the attraction system 50.

The attraction system 50 may include a walkway 54 positioned adjacent to the ride vehicle path. For example, guests may use the walkway 54 to enter and exit the ride vehicle 52, or an operator may use the walkway 54 to service the ride vehicle 52. In the illustrated embodiment, the walkway 54 includes a first barrier 56 disposed at a first location (e.g., side, edge) of the walkway 54 and a second barrier 58 disposed at a second location (e.g., side, edge) of the walkway 54. Here, the first barrier 56 and the second barrier 58 are each disposed at a first side (or face) 59 of the walkway 54. The first barrier 56 and the second barrier 58 may each keep the guests and/or operators within the walkway 54 and guide the guests and/or operators along the walkway 54 (e.g., toward an exit of the attraction system 50). For instance, the walkway 54 may be free standing and the first barrier 56, which may be disposed at a first edge 60 of the walkway 54, may block navigation to the first edge 60. Additionally, the second barrier 58, which may be disposed at a second edge 62 of the walkway 54, may block navigation to the second edge 62. Thus, the first barrier 56 and the second barrier 58 maintain a constrained path defined by the walkway 54.

In the illustrated embodiment, the ride vehicle 52 is positioned proximate to the second edge 62 of the walkway 54. However, the second barrier 58 may block entry into the ride vehicle 52 from the walkway 54 and/or block exit from the ride vehicle 52 onto the walkway 54. To allow for such entry and exit, at least a portion of the second barrier 58 may be configured to move along the walkway 54 to create a clear path from the walkway 54 to the ride vehicle 52. That is, for example, the second barrier 58 may be moved to a position that allows transitioning between the ride vehicle 52 and the walkway 54.

To allow for such movement, in the illustrated embodiment the second barrier 58 is coupled to a carrier 64 (e.g., a movable carrier) disposed at a second side (or face) 65 of the walkway 54 opposite the first side 59. As one example, the carrier 64 may be configured to translate along the second side 65 of the walkway 54. In the illustrated embodiment, the carrier 64 is positioned below the walkway 54 along a vertical axis 66 (oriented parallel to Earth gravity) and the second barrier 58 may be coupled to the carrier 64 through the walkway 54. In this way, the walkway 54 is positioned between the second barrier 58 and the carrier 64, but a feature of the second barrier 58 may extend through the walkway 54 to couple to the carrier 64, as described below. The carrier 64 includes one or more features that allow the carrier to move along the walkway 54. For instance, the carrier 64 may include a bearing (e.g., slide bearing), slider, guideway, or another suitable component configured to linearly travel along a lateral axis 68. That is, the carrier 64 may travel in a first direction 70 toward the first edge 60 of the walkway 54 and in a second direction 72 toward the second edge 62 of the walkway 54.

As the carrier 64 travels in the first direction 70, the carrier 64 may drive the second barrier 58 toward the first barrier 56 (e.g., to a stowed configuration), and may allow navigation to the second edge 62 of the walkway 54. As the carrier 64 travels in the second direction 72, the carrier 64 may drive the second barrier 58 away from the first barrier 56 (e.g., to a stowed configuration), and may block navigation to the second edge 62 of the walkway 54. It should be noted that the position of the second barrier 58 in the stowed configuration does not interfere with navigation across the walkway 54. That is, the surface of the walkway 54 may remain unchanged as the second barrier 58 transitions between the deployed configuration and the stowed configuration. For this reason, the position of the second barrier 58 does not inhibit using the walkway 54 to navigate through the attraction system 50.

Although this disclosure primarily notes that the second barrier 58 is configured to move relative to the walkway 54, it should be noted that the first barrier 56 may additionally or alternatively be configured to move relative to the walkway 54. For instance, in an embodiment of the attraction system 50 having ride vehicles 52 configured to be positioned adjacent to the walkway 54 at both the first edge 60 and the second edge 62, the first barrier 56 may also be moved (e.g., via another carrier 64) to allow navigation between the walkway 54 and the ride vehicle 52 at the first edge 60. Indeed, any configuration described herein for the second barrier 58 may, additionally or alternatively, be applied to the first barrier 56.

In a further embodiment, the second barrier 58 may be configured to rotate to enable navigation to the second edge 62. For instance, the second barrier 58 may be rotatably coupled to the carrier 64 and may rotate about an axis 67 in a rotational direction 73 to be oriented along (e.g., substantially parallel to) the walkway 54. Such an orientation of the second barrier 58 may also allow navigation between the walkway 54 and the ride vehicle 52. In yet another embodiment, the second barrier 58 may be removed to allow navigation between the walkway 54 and the ride vehicle 52. By way of example, the second barrier 58 may be removably coupled to the carrier 64 to enable the second barrier 58 to be removed (e.g., decoupled) from the walkway 54 to allow navigation to the second edge 62 of the walkway 54.

In one embodiment, the second barrier 58 may be moved via a user, such as by a worker (e.g., an operator) of the attraction system 50. That is, the user may manually move the second barrier 58 in the first direction 70 and the second direction 72. The user may position the second barrier 58 at a target position relative to the walkway 54. For instance, the user may position the second barrier 58 at an intermediary position between the first edge 60 and the second edge 62, such as to partially block navigation of a portion of the walkway 54. It should be noted that in the embodiments discussed herein, the user may move the second barrier 58 without being exposed at the second edge 62 of the walkway 54. For example, the user may move the second barrier 58 while positioned between the first barrier 56 and the second barrier 58. As such, the second barrier 58 blocks the user at the second edge 62 of the walkway 54, and the first barrier 56 blocks the user at the first edge 60 of the walkway 54.

In an additional or an alternative embodiment, the second barrier 58 may be moved automatically, such as via a controller 74 of the attraction system 50. The controller 74 may be disposed at any suitable location, such as within the attraction system 50 or at a location outside of the attraction system 50, to move the second barrier 58 remotely. The controller 74 may include a memory 76 and a processor 78. The memory 76 may be a mass storage device, a flash memory device, removable memory, or any other non-transitory computer-readable medium that includes instructions to operate the attraction system 50, such as to move the second barrier 58 and/or to control other show effects (e.g., lighting, a speed of the ride vehicle 52) of the attraction system 50. The memory 76 may also include volatile memory, such as randomly accessible memory (RAM) and/or non-volatile memory, such as hard disc memory, flash memory, and/or other suitable memory formats. The processor 78 may execute the instructions stored in the memory 76.

In one embodiment, the controller 74 may be communicatively coupled to a sensor 80 and may receive feedback from the sensor 80 to adjust the position of the second barrier 58. For example, the sensor 80 may be configured to determine an operating parameter of the attraction system 50 and may transmit feedback indicative of the operating parameter to the controller 74. Based on the feedback, the controller 74 may be configured to activate an actuator 82 of the carrier 64 to move the carrier 64 relative to the walkway 54, thereby moving the second barrier 58 relative to the walkway 54. By way of example, the sensor 80 may include a proximity sensor (e.g., a laser sensor) configured to determine that the ride vehicle 52 is proximate to the walkway 54, a clock configured to monitor a time associated with the operation of the attraction system 50, another suitable sensor such as a pressure sensor, camera system, and so forth. In an additional or an alternative embodiment, the controller 74 may be configured to receive a user input and may activate the actuator 82 to move the carrier 64 and the second barrier 58 in response to receiving the user input.

Figure 2:
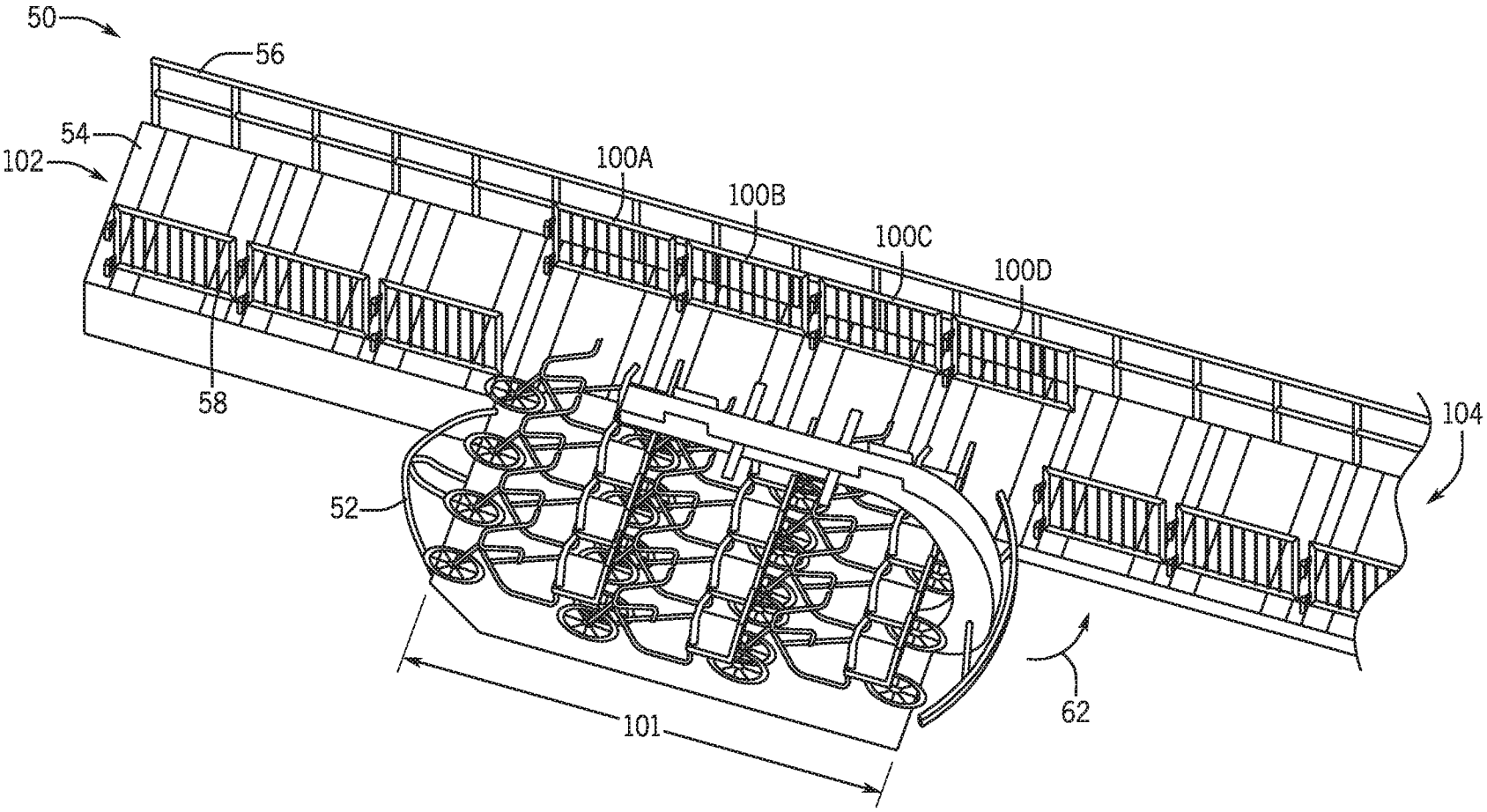
FIG. 2 is a perspective view of an embodiment of the attraction system of FIG. 1 having multiple segments of the movable barrier, in accordance with an aspect of the present disclosure.

FIG. 2 is a perspective view of an embodiment of the attraction system 50 having multiple segments 100 of the second barrier 58. At least some of the segments 100 of the second barrier 58 may be moved independently of other segments 100. In the illustrated embodiment, four segments 100, which may align along a length 101 of the ride vehicle 52, have been moved to the stowed configuration. Thus, the position of the second barrier 58 allows navigation between the walkway 54 and the ride vehicle 52. Additionally, a remainder of the second barrier 58 (the remaining segments 100) may be maintained in the deployed configuration to maintain access to within the walkway 54 between the first barrier 56 and the second barrier 58.

FIG. 2 depicts that each of the stowed segments 100 are substantially aligned with one another in the stowed configuration, thereby allowing navigation toward both a first section 102 and a second section 104 of the walkway 54. However, the stowed segments 100 may alternatively be offset from one another. For example, a first stowed segment 100A may be positioned most proximate to the first barrier 56, a second stowed segment 100B may be positioned farther from the first barrier 56 than the first stowed segment 100A is positioned from the first barrier 56, and a third stowed segment 100C may be positioned farther from the first barrier 56 than the second stowed segment 100B is positioned from the first barrier 56. A fourth stowed segment 100D may be positioned even farther from the first barrier 56 than the third stowed segment 100C is positioned from the first barrier 56, such that the fourth stowed segment 100D is positioned most proximate to the ride vehicle 52. Thus, the stowed segments 100 may form a substantially diagonal orientation that may block navigation toward the second section 104 of the walkway 54, and may be allow navigation toward the first section 102 of the walkway 54.

Although the illustrated implementation includes four stowed segments 100 that have been moved to the stowed configuration, it should be noted that any suitable number of stowed segments 100 may be moved to the stowed configuration to enable the transitioning between the ride vehicle 52 and the walkway 54. In one example, for a ride vehicle 52 having a longer length than the length 101 of the ride vehicle 52 of FIG. 2, additional stowed segments 100 may be moved to the stowed configuration. In another example, transitioning between the walkway 54 and the ride vehicle 52 may be allowed at a particular length, which may be a portion of the length 101, of the ride vehicle 52. Thus, the stowed segments 100 that are located adjacent to the particular length, rather than the entire length 101, of the ride vehicle 52 may be moved to the stowed configuration.

Figure 3:
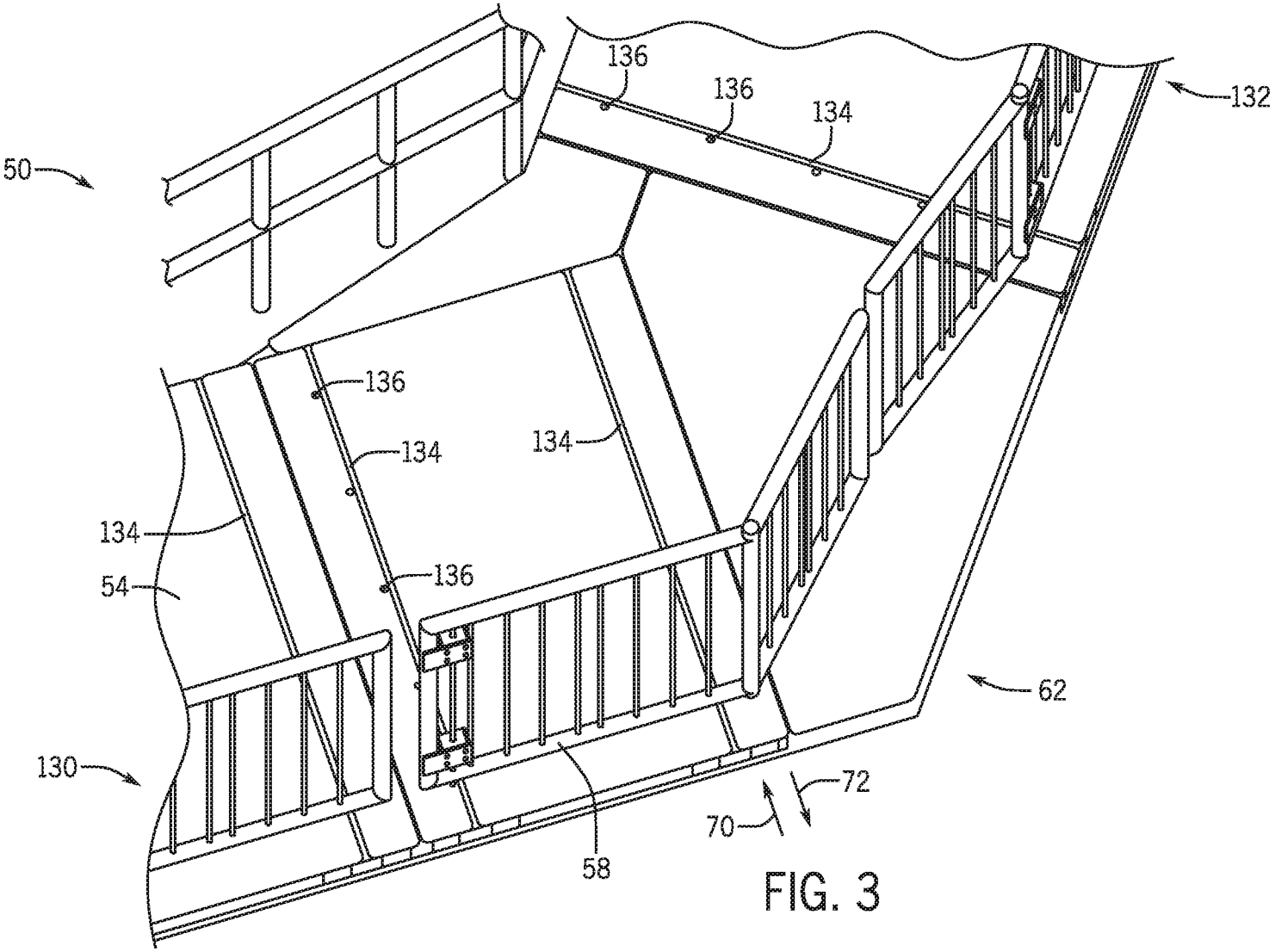
FIG. 3 is a perspective view of an embodiment of the attraction system having the movable barrier in a deployed configuration, in accordance with an aspect of the present disclosure.

FIG. 3 is a perspective view of an embodiment of the attraction system 50 having the second barrier 58 in the deployed configuration. That is, each segment of the second barrier 58 may be positioned proximate to the second edge 62 of the walkway 54. The illustrated embodiment shows a corner of the walkway 54 that may have a first set 130 of second barriers 58 and a second set 132 of second barriers 58, in which the first set 130 of second barriers 58 are disposed at an angle with respect to the second set 132 of second barriers 58. Because the barriers 58 are movable relative to one another and are capable of rotation, the barriers 58 may be used accommodate any number of different geometries for the walkway 54.

As shown in FIG. 3, the walkway 54 includes openings 134 that enable each segment of the second barriers 58 to couple to respective carriers 64 disposed underneath the walkway 54. For instance, as discussed in further detail below, each segment of the second barriers 58 may have a connector that extends through the walkway 54 via the opening 134 to couple to one of the carriers 64. Each opening 134 may extend laterally along the walkway 54 to enable each segment of the second barriers 58 to transition along the walkway 54 (e.g., along the first direction 70 and/or the second direction 72), while remaining coupled to the respective carriers 64 and while remaining in an engaged relationship with the walkway 54. It should be noted that the size of each opening 134 may be small relative to the size of the walkway 54 as to limit interfering with navigation along the walkway 54. That is, the opening 134 may be sized in accordance with any appropriate standards and at least so that the opening 134 the walkway 54 is in compliance with appropriate requirements to allow for navigation of the walkway 54.

Furthermore, the walkway 54 may include apertures 136 that are positioned proximate and/or generally along the openings 134. The apertures 136 may enable each of the second barriers 58 to maintain a position along the walkway 54. For instance, at least certain segments of the second barriers 58 may have a rod or insert configured to extend into one of the apertures 136. The aperture 136 may capture the rod and block movement of the rod relative to the walkway 54, thereby blocking movement of the segment of the second barrier 58 relative to the walkway 54. There may be a plurality of apertures 136 disposed along the respective openings 134 to enable each segment of the second barriers 58 to be moved to a particularly desired position relative to the walkway 54. For example, one of the apertures 136 may enable the second barrier 58 to be securely positioned adjacent to the second edge 62 of the walkway 54, and block navigation to the second edge 62.

Figure 4:
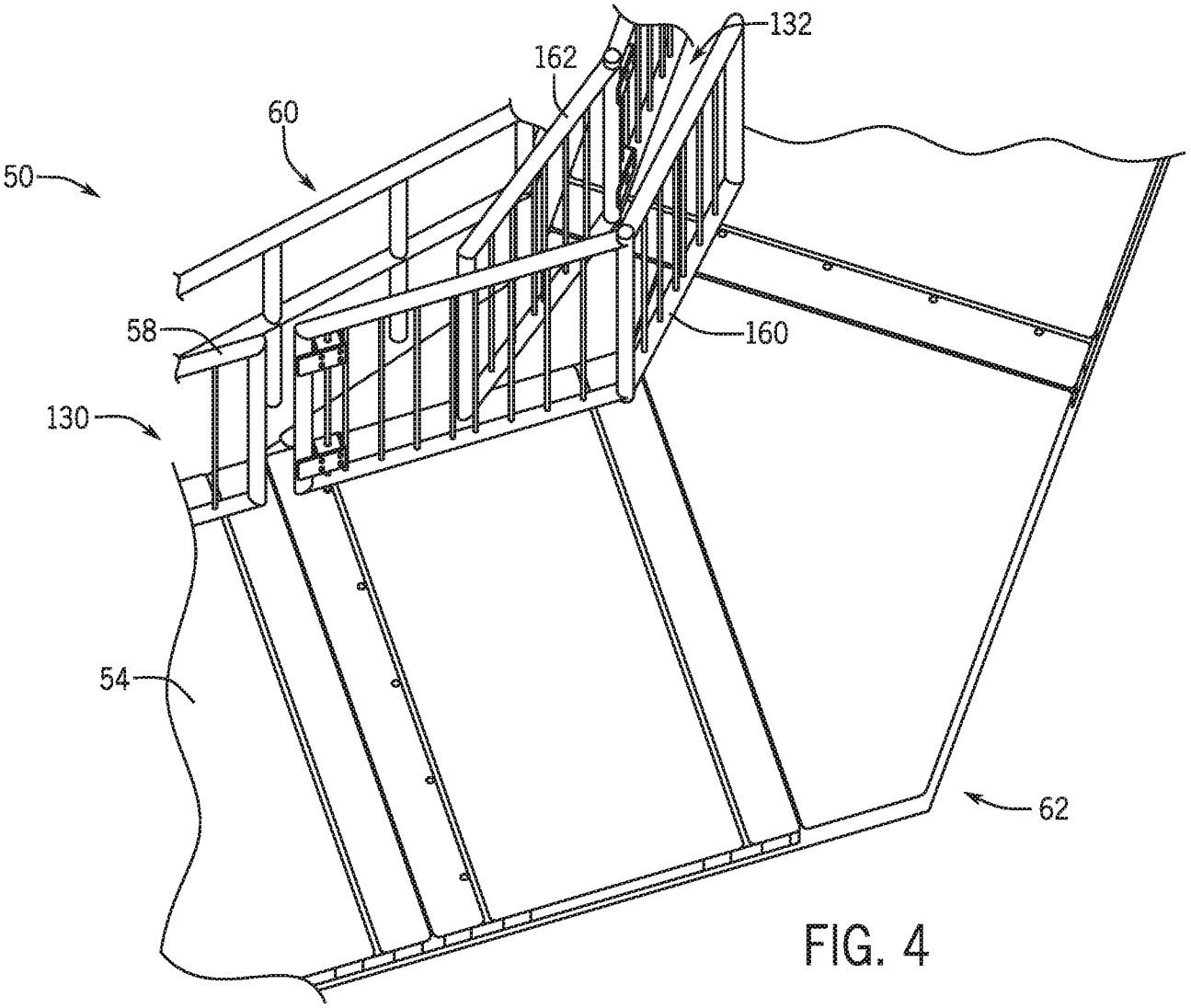
FIG. 4 is a perspective view of an embodiment of the attraction system having the movable barrier in a stowed configuration, in accordance with an aspect of the present disclosure.

FIG. 4 is a perspective view of an embodiment of the attraction system 50 having the second barrier 58 in the stowed configuration. That is, each segment of the second barrier 58 may be positioned proximate to the first edge 60 of the walkway 54. As such, the second barrier 58 does not block navigation to the second edge 62 of the walkway 54. In the illustrated embodiment, due to the angle between the first set 130 of second barriers 58 and the second set 132 of second barriers 58, a first portion 160 of the first set 130 of second barriers 58 may be configured to overlap with a second portion 162 of the second set 132 of second barriers 58. In this manner, the first set 130 of second barriers 58 and the second set 132 of second barriers 58 do not interfere with one another, such as to inhibit movement of the first set 130 of second barriers 58 and/or the second set 132 of second barriers 58 along the walkway 54. These types of overlaps may be present in configurations in which the walkway 54 has curves, angles, turns, and so forth.

Figure 5:
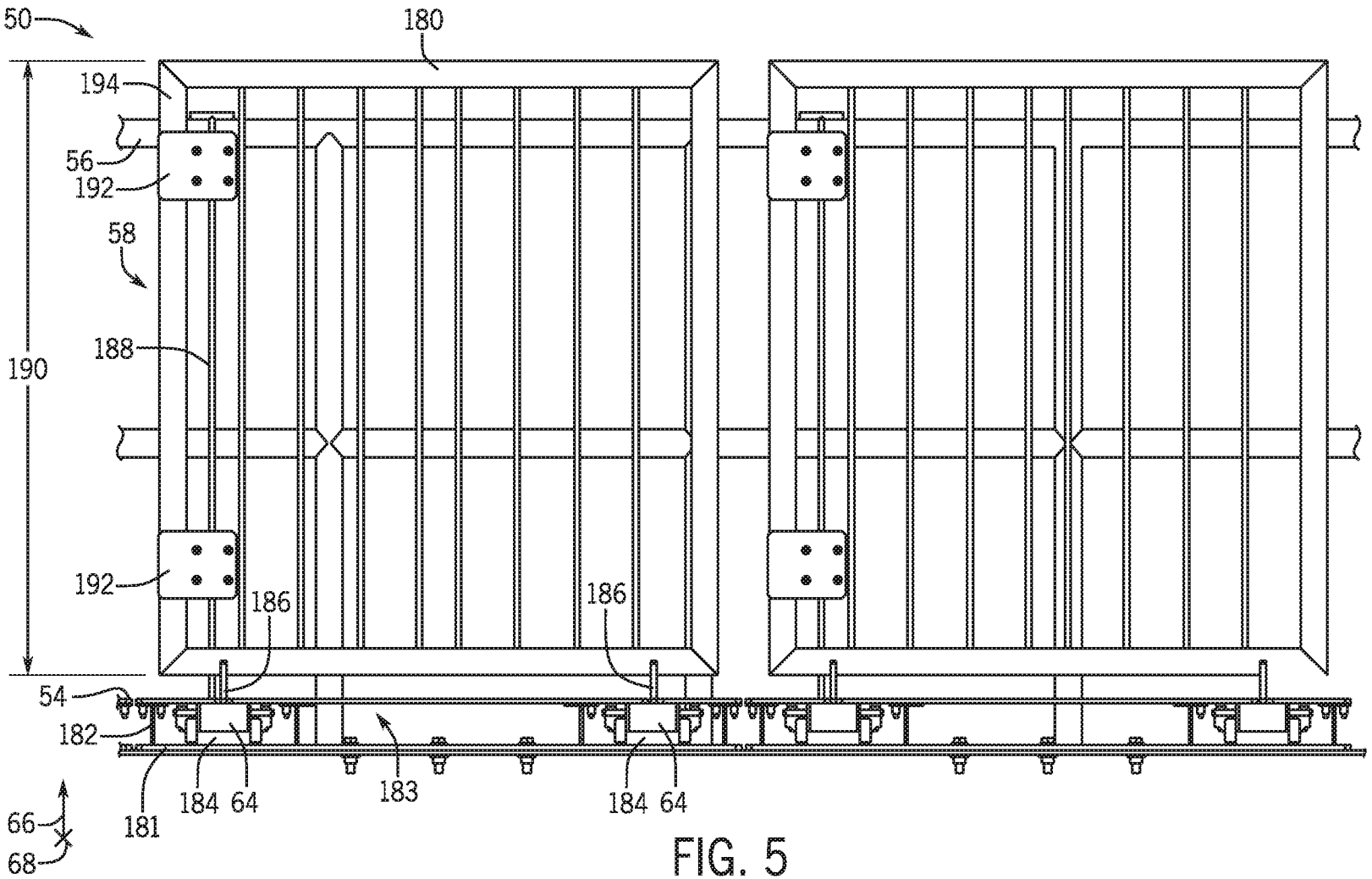
FIG. 5 is a front elevation view of an embodiment of the attraction system having segments of the movable barrier secured to a walkway, in accordance with an aspect of the present disclosure.

To help illustrate the manner in which the barriers engage the walkway 54, FIG. 5 is a front elevation view of an embodiment of the attraction system 50 illustrating two segments 180 of the second barrier 58. As shown in FIG. 5, the walkway 54 is supported above a base 181 extending along the walkway 54. For example, a support 182 may offset the walkway 54 from the base 181 to form a space 183 between the base 181 and the walkway 54. The carrier 64 may be disposed in the space 183, and each of the segments 180 may be coupled to two carriers 64 through the walkway 54. In an additional or an alternative embodiment, each segment 180 may be coupled to any number of carriers 64. Each carrier 64 may be slidably coupled to a respective rail 184, such that each carrier 64 may translate along the respective rail 184 along the lateral axis 68. Each segment 180 may include a connector 186 configured to couple to one of the carriers 64. For instance, each segment 180 may have two connectors 186 to couple the segment 180 to two separate carriers 64. As shown in FIG. 5, each segment 180 is separate from one another, thereby enabling the respective segments 180 to move independently from one another along the lateral axis 68.

In one embodiment, each segment 180 includes a rod 188 extending along a vertical length 190 (e.g., a height) of the segment 180, in which the rod 188 is configured to extend through one of the apertures 136 of the walkway 54 to maintain a position of the segment 180. Each segment 180 may include one or more mounts 192 configured to facilitate maintaining a position of the rod 188 relative to the segment 180. For example, a component may be coupled to each mount 192 to hold the rod 188. Each mount 192 may be coupled to a side railing 194 (e.g., a railing defining an outer perimeter of the segment) of each segment 180, such that the positions of the respective mounts 192 are maintained relative to the respective segments 180. Although the illustrated embodiment depicts that each segment 180 includes two mounts 192, an additional or an alternative embodiment of the segment 180 may have any number of mounts 192 to maintain the position of the rod 188 relative to the segment 180. The rod 188 may be adjustable relative the mount 192 and to the segment 180 to insert into one of the apertures 136 to maintain the position of the segment 180, and to be removed from the aperture 136 to enable the segment 180 to be adjusted relative to the walkway 54.

Figure 6:
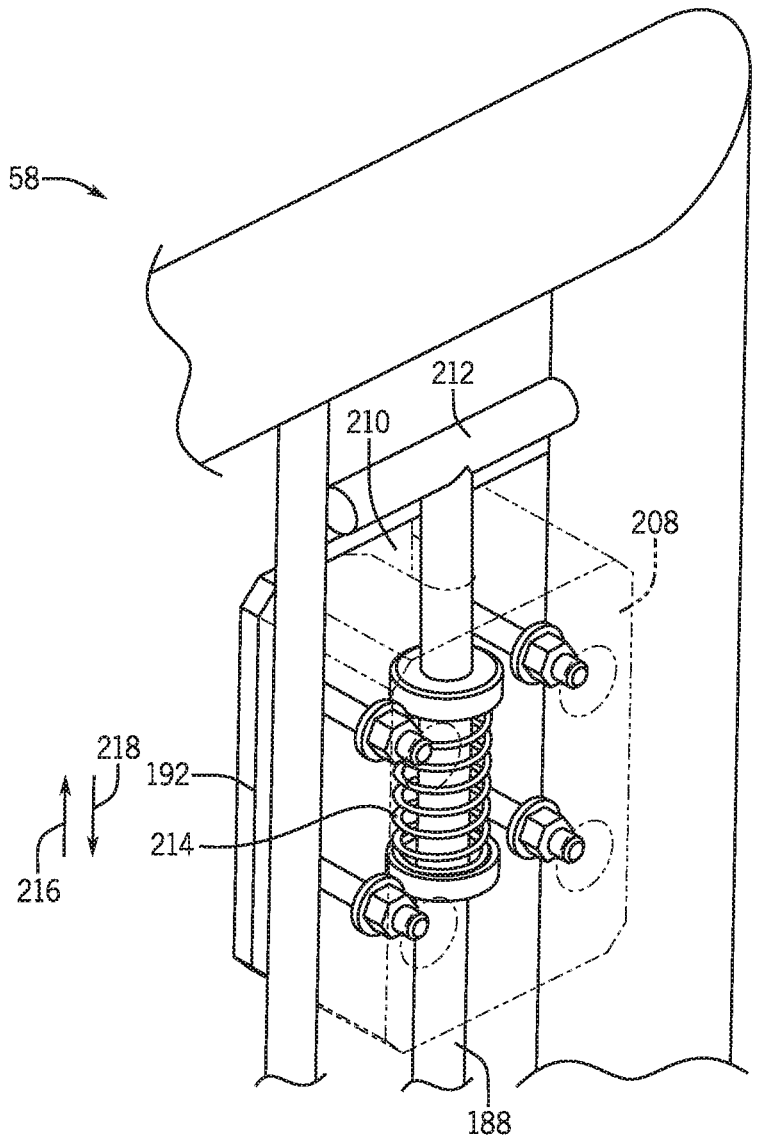
FIG. 6 is a detailed perspective view of an embodiment of the movable barrier having a rod coupled to the movable barrier, in accordance with an aspect of the present disclosure.

FIG. 6 is a detailed view of an embodiment of the manner in which the rod 188 may be coupled to the second barrier 58 via one of the mounts 192. The rod 188 may extend through an enclosure 208 configured to couple to one of the mounts 192. For purposes of discussion and visualization, the enclosure 208 is transparent in FIG. 6. As illustrated in FIG. 6, the enclosure 208 may have an opening 210 through which the rod 188 may extend. As discussed, the rod 188 may be movable relative to the enclosure 208 and to the second barrier 58. For example, the rod 188 may have a handle 212 that is shaped to allow a user to grip and move the rod 188 by hand (e.g., without tools). In the illustrated embodiment, the handle 212 is T-shaped, but the handle 212 may alternatively be shaped in any manner to allow the user to have a secure grip to move the rod 188. Additionally, within the enclosure 208, the rod 188 may be coupled to a biasing member 214 (e.g., a spring). The biasing member 214 may resist movement to maintain a particular position of the rod 188. For example, the user may move the rod 188 in a first vertical direction 216 (e.g., to remove the rod 188 from the aperture 136) to extend the biasing member 214. Once the user releases the rod 188, the biasing member 214 may retract to its resting (i.e., unbiased) state and move the rod 188 in a second vertical direction 218 (e.g., to extend into another aperture 136). In this manner, the biasing member 214 is configured to maintain the position of the rod 188 to remain extended into the aperture 136, thereby maintaining the position of the second barrier 58 relative to the walkway 54.

Figure 7:
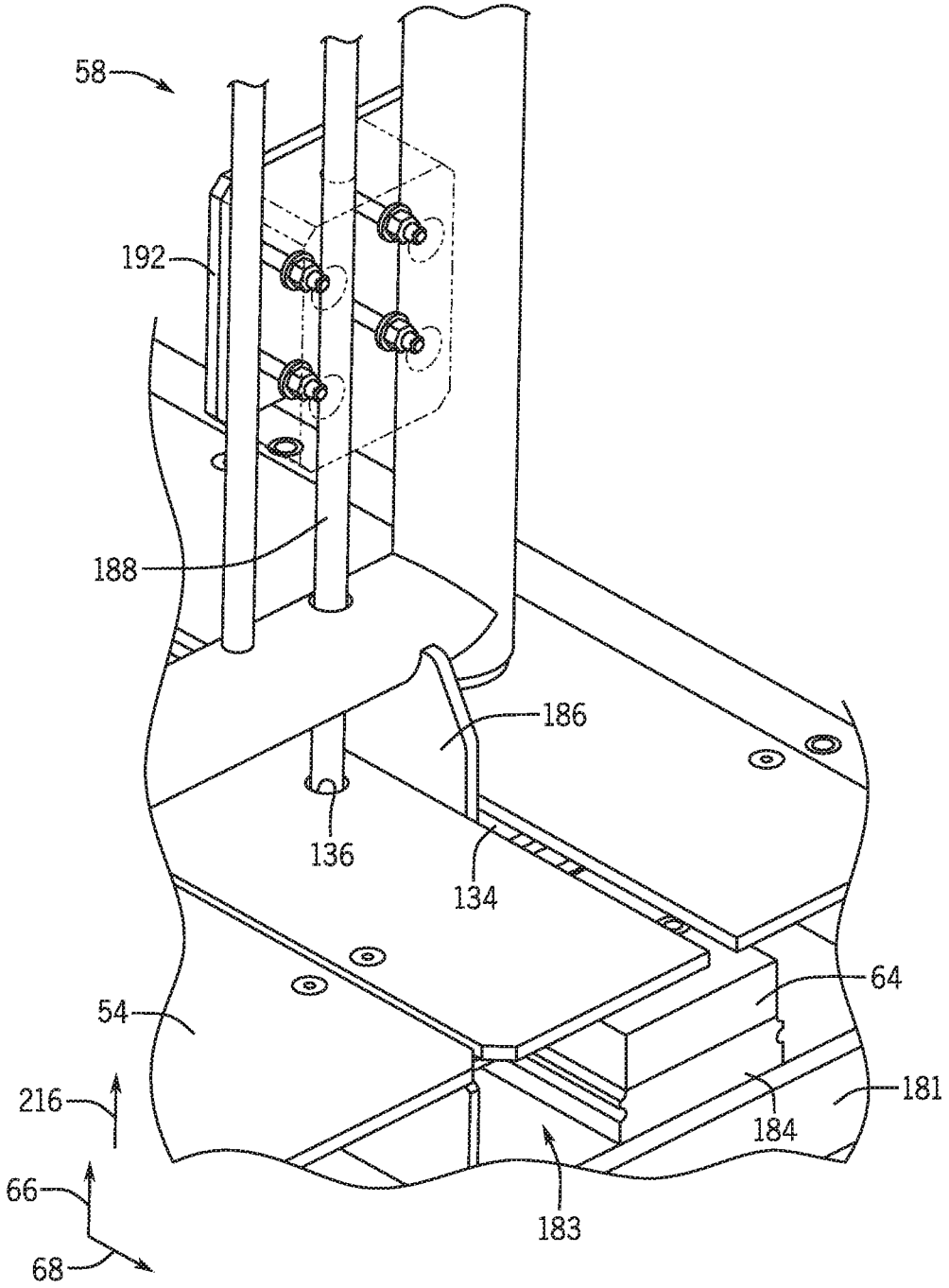
FIG. 7 is a detailed perspective view of an embodiment of the movable barrier, in which the rod of FIG. 6 extends through an aperture of a walkway to maintain a position of the movable barrier, in accordance with an aspect of the present disclosure.

FIG. 7 is a detailed view of an embodiment of the second barrier 58, in which the rod 188 is extending through one of the apertures 136 of the walkway 54 to maintain the position of the second barrier 58. That is, the rod 188 may extend through the walkway 54 and into the space 183 between the walkway 54 and the base 181. As illustrated in FIG. 7, the rod 188 has an approximately cylindrical shape and the aperture 136 has an approximately circular shape that substantially matches with the shape of the rod 188. As such, movement of the rod 188 relative to the walkway 54 along the lateral axis 68 is blocked, and movement of the second barrier 58 relative to the walkway 54 is blocked. Thus, the position of the second barrier 58 relative to the walkway 54 is maintained while the rod 188 extends into the aperture 136. Other matching geometries may be used for the rod 188 and the aperture 136 as appropriate.

When the rod 188 is moved in the first vertical direction 216, the rod 188 may clear the aperture 136 above the walkway 54 along the vertical axis 66. Movement of the rod 188 relative to the walkway 54 along the lateral axis 68 is allowed when the rod 188 is clear of the aperture 136. For example, the carrier 64 may slide along the rail 184 along the lateral axis 68 to enable the connector 186 to slide within the opening 134 and to enable the second barrier 58 to move relative to the walkway 54 along the lateral axis 68. In the illustrated implementation, the connector 186 is a plate that couples the second barrier 58 to the carrier 64, such as via a weld, an adhesive, a fastener, another suitable component, or any combination thereof. In an additional or an alternative embodiment, the connector 186 may be another component, such as a rod, that may be configured to insert through the walkway 54 to couple the second barrier 58 to the carrier 64.

Figure 8:
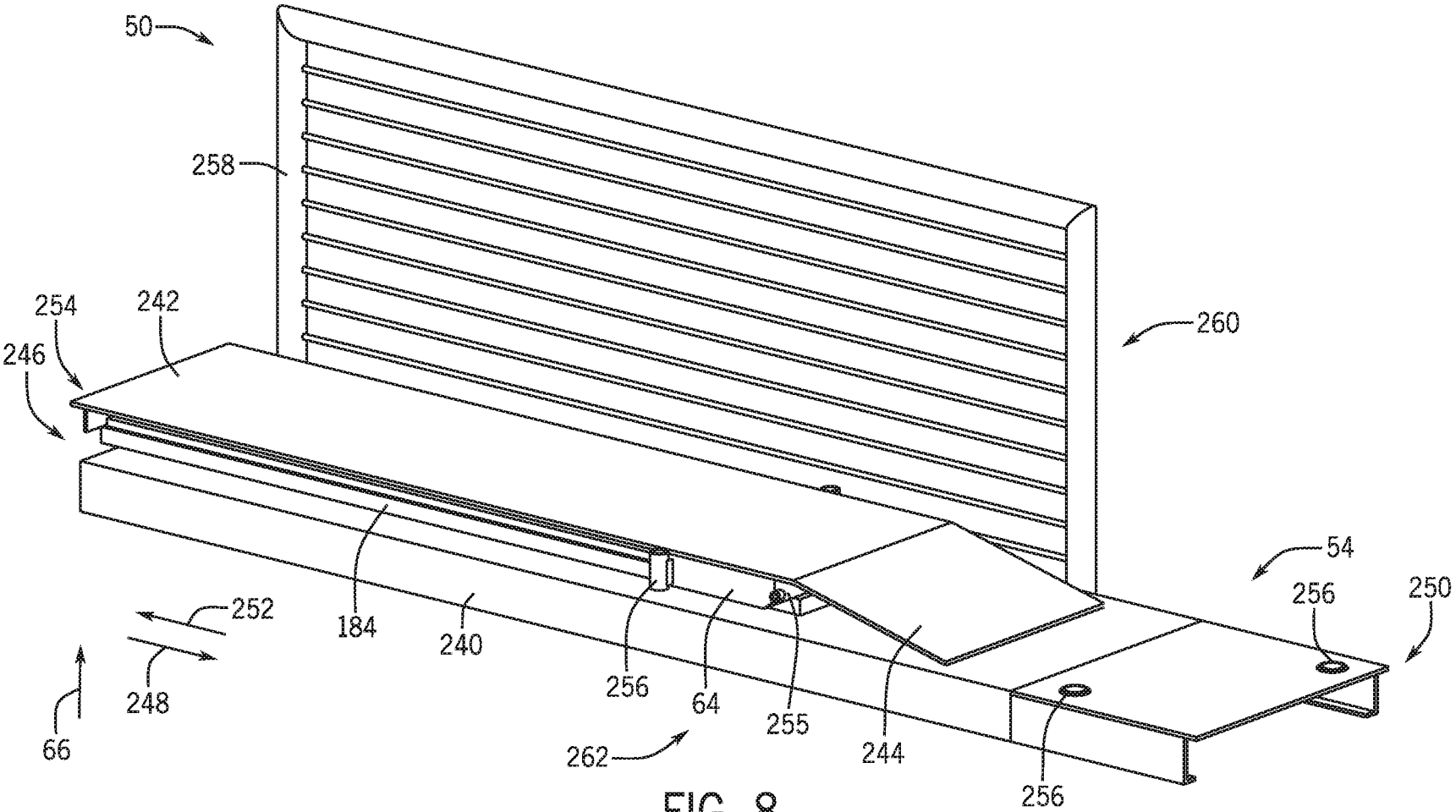
FIG. 8 is a perspective view of another embodiment of the attraction system having the movable barrier in a stowed configuration, in accordance with an aspect of the present disclosure.

FIG. 8 is a perspective view of an embodiment of the attraction system 50 having a movable barrier in the stowed configuration. In particular, the walkway 54 of FIG. 8 includes a lower walkway 240 and an elevated walkway 242 positioned above the lower walkway 240 along the vertical axis 66. In one embodiment, the elevated walkway 242 includes a ramp 244 that gradually transitions from the lower walkway 240 to the elevated walkway 242 and thereby forms a space 246 between the lower walkway 240 and the elevated walkway 242. The ramp 244 also allows navigation between the lower walkway 240 and the elevated walkway 242.

In the illustrated embodiment, the carrier 64 is slidably coupled to the rail 184, and the carrier 64 and the rail 184 are each be disposed in the space 246. For example, the carrier 64 may be configured to travel along the rail 184 in a first direction 248 toward an inner portion 250 of the walkway 54. The carrier 64 may also be configured to travel along the rail 184 in a second direction 252 toward an outer portion 254 (e.g., an edge) of the walkway 54.

To maintain or secure the carrier 64 relative to the walkway 54, in a certain embodiment, the elevated walkway 54 and/or the rail 184 may include an attachment 255 fixed to the walkway 54 adjacent to the inner portion 250. The carrier 64 may be configured to couple to the attachment 255 to secure the position of the carrier 64 adjacent to the inner portion 250, such as proximate to the ramp 244. For example, the carrier 64 may be removably coupled to the attachment 255 to allow ready coupling to and decoupling from the attachment 255, and allow the carrier 64 to be secured to the attachment 255 or moved toward the outer portion 254 as desired.

As depicted, the carrier 64 may include a receptacle 256 configured to receive a barrier and to couple the barrier to the carrier 64, for example to limit movement of the barrier relative to the carrier 64. Moreover, in one embodiment, the lower walkway 240 may additionally include the receptacle 256 to hold the barrier in place at the lower walkway 240. For instance, the barrier may be coupled to the lower walkway 240 to direct navigation along the walkway 54 at the inner portion 250.

The walkway 54 may include one or more stationary barriers 258 that enclose the walkway 54. In the illustrated embodiment, the stationary barrier 258 is disposed at a first side 260 of the walkway 54. In an additional or an alternative embodiment, the stationary barrier 258 may be disposed at a second side 262 of the walkway 54. As such, navigation may be maintained between the inner portion 250 and the outer portion 254 of the walkway 54.

Figure 9:
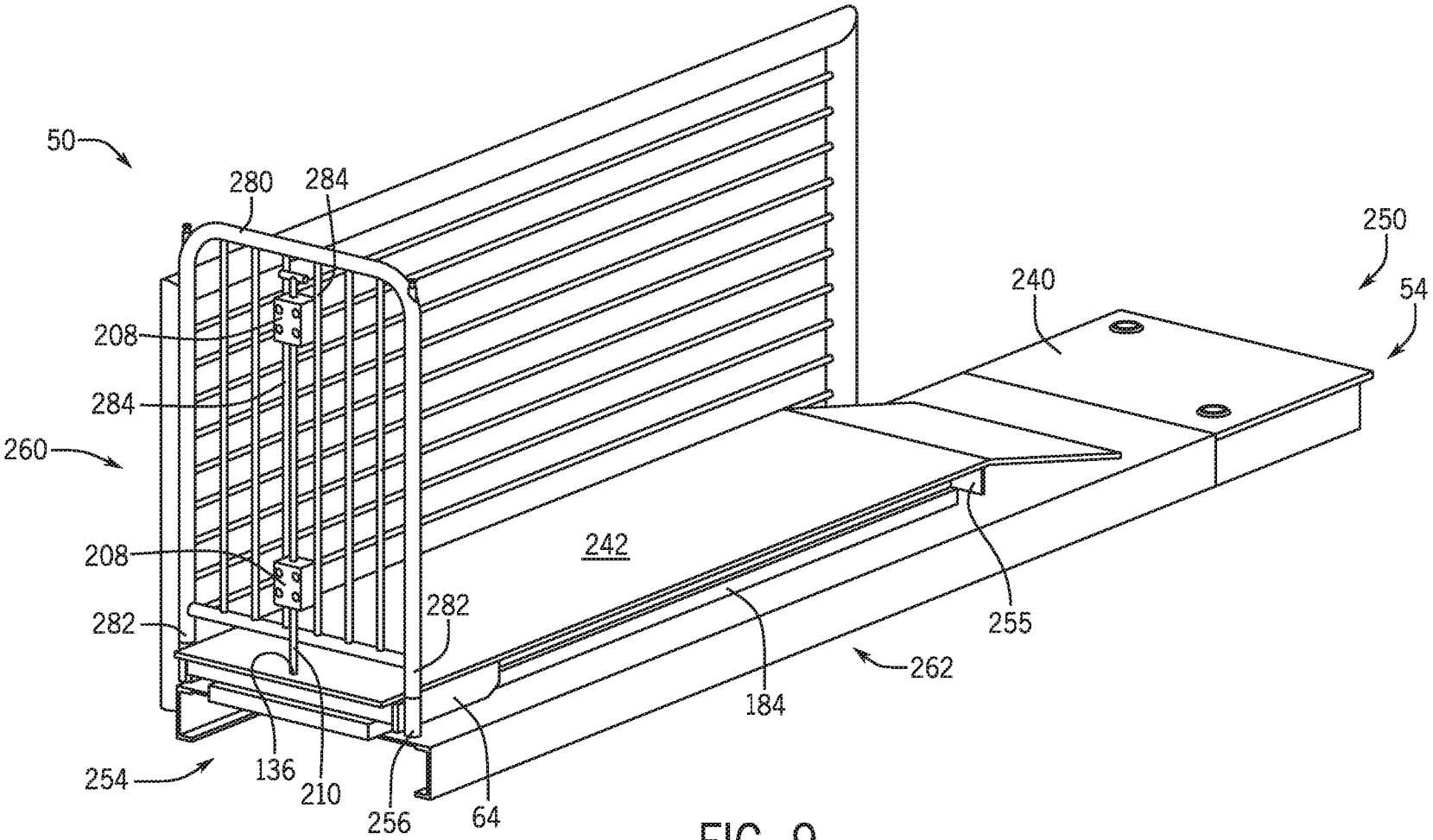
FIG. 9 is a perspective view of an embodiment of the attraction system of FIG. 8 having the movable barrier in a deployed configuration, in accordance with an aspect of the present disclosure.

FIG. 9 is a perspective view of an embodiment of the attraction system 50 having a movable barrier 280 in a deployed configuration. For example, the movable barrier 280 may include extensions 282 that are each configured to insert into one of the receptacles 256 of the carrier 64. In the illustrated embodiment, the carrier 64 includes two receptacles 256 that are located adjacent to the first side 260 and the second side 262, respectively, of the walkway 54, and the movable barrier 280 includes two extensions 282 that are each configured to insert into one of the receptacles 256. When coupled to the carrier 64, the movable barrier 280 may straddle the elevated walkway 242.

The movable barrier 280 may also include the rod 188 that is coupled to the movable barrier 280 via the enclosures 208. In one embodiment, the enclosures 208 may be disposed between railings 284 of the movable barrier 208, and the rod 188 may extend into the elevated walkway 242. The elevated walkway 242 may include one or more of the apertures 136 that may receive the rod 188 to block movement of the movable barrier 280 relative to the walkway 242. For example, the aperture 136 may be disposed proximate to the outer portion 254 of the walkway 54 to enable the movable barrier 280 to be secured at the outer portion 254 of the walkway 54. Additionally or alternatively, the aperture 136 may be disposed proximate to the inner portion 250 of the walkway 54 to enable the movable barrier 280 to be secured at the inner portion 250 by extending the rod 188 through the aperture 136 in addition to coupling the carrier 64 to the attachment 255.

Figure 10:
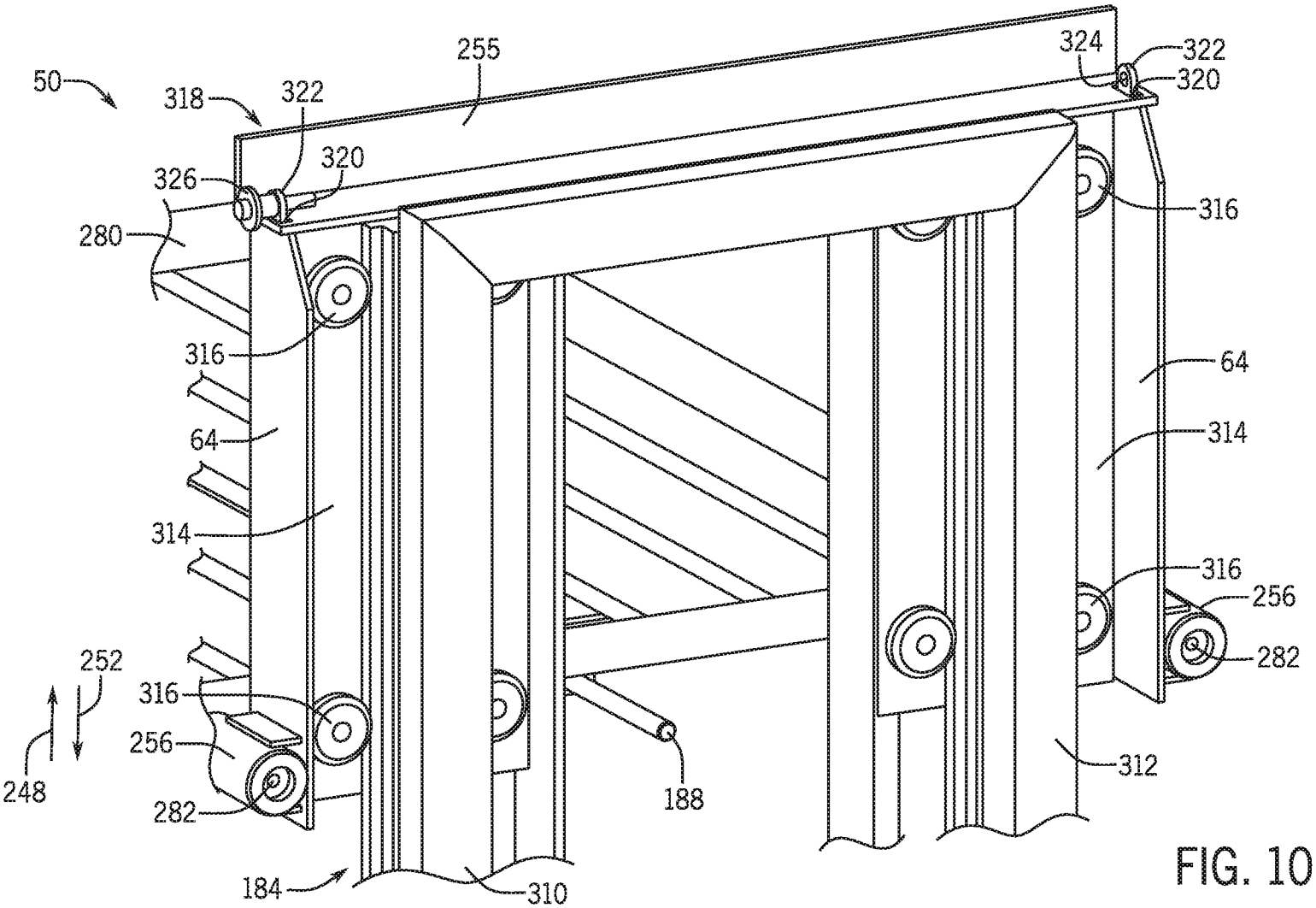
FIG. 10 is a bottom view of an embodiment of the attraction system of FIG. 9 having the movable barrier, illustrating the carrier coupled to a rail and an attachment, in accordance with an aspect of the present disclosure.

FIG. 10 is a bottom view of an embodiment of the attraction system 50 illustrating the carrier 64 coupled to the rail 184 and to the attachment 255. For purposes of discussion and visualization, the elevated walkway 242 is not illustrated in FIG. 10. The rail 184 may have a U-shape that includes a first leg 310 and a second leg 312. A separate carrier 64 may be slidably coupled to the respective legs 310, 312 to enable each carrier 64 to transition in the first direction 248 and the second direction 252 relative to the legs 310, 312. Each carrier 64 may have a separate receptacle 256 to which respective extensions 282 of the movable barrier 280 may couple. Each carrier 64 may include a surface 314 that may abut against the rail 184. The surface 314 may be modified, such as via lubricant and/or surface smoothing, to reduce friction between the surface 314 and the rail 184 and enable greater movement of the carrier 64 along the rail 184. Each carrier 64 may additionally include rollers 316 configured to engage the rail 184. The rollers 316 may rotate relative to the surface 314 and to the rail 184 and further enable movement of the carrier 64 along the rail 184.

In one embodiment, the attachment 255 is coupled to an end 318 of the rail 184 (e.g., by transitioning the carrier 64 in the first direction 248). The attachment 255 may have a slot 320 that may receive a flange 322 of the carrier 64. Furthermore, the flange 322 may have a hole 324 that may be exposed when the flange 322 is fully inserted into the slot 320. The hole 324 may receive an insert 326. For example, the insert 326 may be a pushpin, a screw and nut, a rivet, another suitable component, or any combination thereof that may securely remain inserted within the hole 324. The insert 326 may extend through the hole 324 to block the flange 322 from being removed out of the slot 320 (e.g. by transitioning the carrier 64 in the second direction 252), thereby securing the carrier 64 to the attachment 255 and maintaining the position of the movable barrier 280. The insert 326 may be easily removed from the hole 324 to enable the flange 322 to be removed from the slot 320, and to enable the carrier 64 to move along the rail 184.

Figure 11:
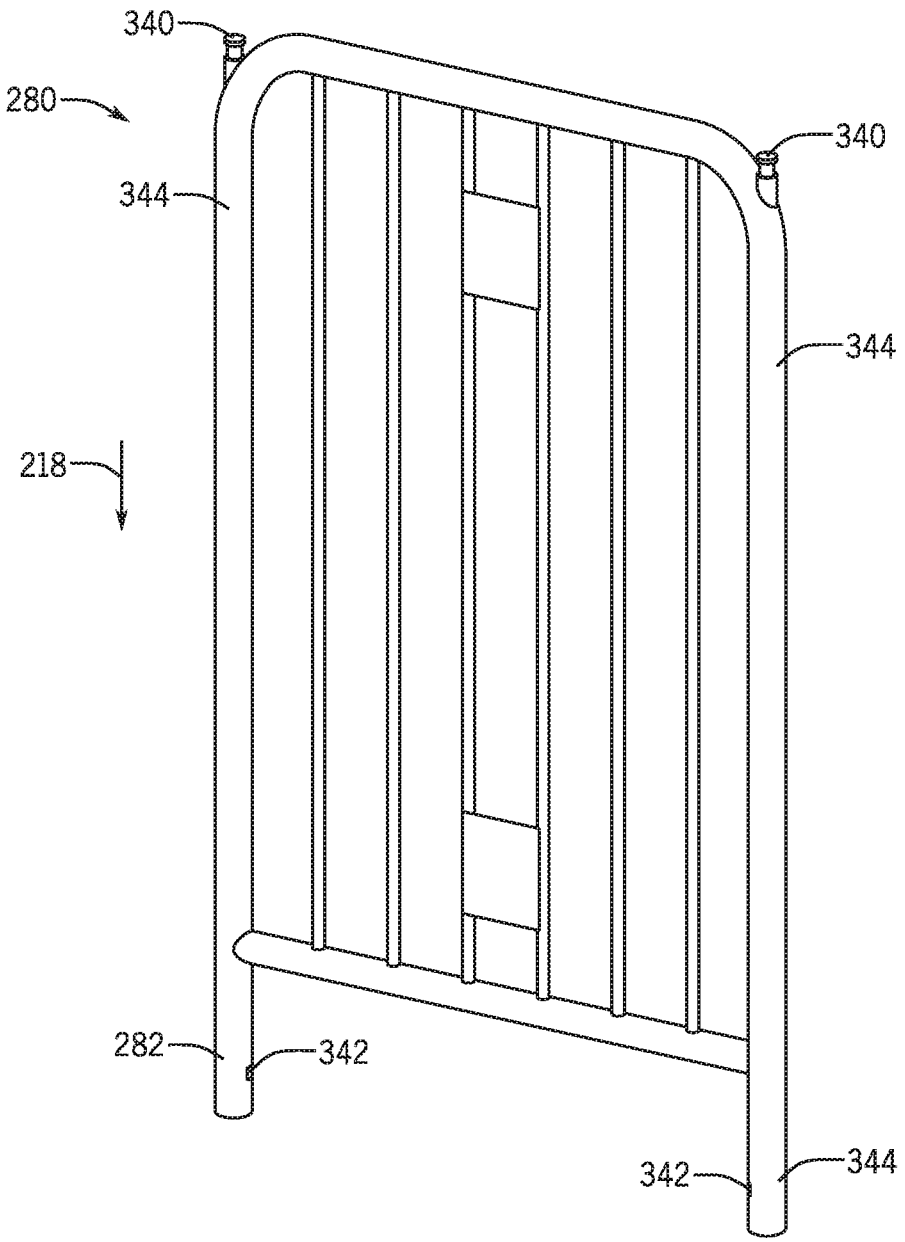
FIG. 11 is a perspective view of an embodiment of the movable barrier that may be coupled to receptacles of the carrier and/or of a walkway, in accordance with an aspect of the present disclosure.

FIG. 11 is a perspective view of an embodiment of the movable barrier 280 that may be coupled to the receptacles 256 of the carrier 64 and/or of the lower walkway 240. The movable barrier 280 may have knobs 340 that may be used to facilitate removing the movable barrier 280 from the receptacles 256. As an example, the movable barrier 280 may include a respective latch 342 configured to protrude through the extension 282 (e.g., in a direction transverse relative to a direction used to remove the extension 282 from the receptacle 256). Each receptacle 256 may include a notch or recess configured to receive the latch 342 and enable the movable barrier 280 to couple to the receptacle 256. Each latch 342 may be adjustable via the respective knobs 340. For example, the knob 340 may be moved relative to a remainder of the movable barrier 280 in the second vertical direction 218 and may retract the latch 342, such that the latch 342 no longer protrudes through the extension 282 and no longer engages the notch of the receptacle 256. Thus, the movable barrier 280 may be removed from the receptacle 256. As illustrated in FIG. 11, each knob 340 may be aligned with a respective side rail 344 of the movable barrier 280, in which the side rail 344 extends into one of the extensions 282. For this reason, the knob 340 may be coupled to a mechanism within the side rail 344 and/or the extension 282 to enable the knob 340 to move the latch 342. Additionally or alternatively, each knob 340 may be located or oriented in a different manner on the movable barrier 280.

FIG. 12 is a partial cross-sectional side view of an embodiment of one of the extensions 282 of the movable barrier 280 inserted into one of the receptacles 256, in which the movable barrier 280 is in an engaged configuration with the receptacle 256. It should be noted that the latch 342 is part of an assembly of components that allow coupling and decoupling of the extensions 282 in the receptacles 256. In the engaged configuration, the extension 282 of the movable barrier 280 is inserted through the receptacle 256, and a protrusion 370 of the latch 342 extends through the extension 282 and the receptacle 256. For example, in the engaged configuration, an opening 372 of the extension 282 may align with a notch 374 of the receptacle 256. Thus, the latch 342 may be oriented to enable the protrusion 370 to extend through both the opening 372 of the extension 282 and the notch 374 of the receptacle 256.

The latch 342 may be rotatably coupled to a housing 376, such as at a pivot 377, disposed within the extension 282. The housing 376 may include a projection 378 configured to extend through a holder 380 that is fixed relative to the extension 282. The projection 378 may include a retainer 382 configured to abut a first side 384 of the holder 380 and block movement of the housing 376 in the first vertical direction 216 relative to the extension 282. Additionally, a biasing member 386 may be attached to the projection 378 at a second side 388 of the holder 380 to resist movement of the housing 376 in the second vertical direction 218 relative to the extension 282. As such, the retainer 382 and the biasing member 386 may maintain a position of the housing 376 within the extension 282, and may also maintain a position of the latch 342 to extend the protrusion 370 through the opening 372 of the extension 282 and the notch 374 of the receptacle 256. In this manner, in the engaged configuration of the movable barrier 280, movement of the extension 282 relative to the receptacle 256 is blocked to couple the extension 282 with the receptacle 256.

FIG. 13 is a partial cross-sectional side view of an embodiment of one of the extensions 282 of the movable barrier 280 inserted into one of the receptacles 256 in a disengaged configuration. In one embodiment, the movable barrier 280 may transition between the engaged configuration and the disengaged configuration via movement of a rod 410 disposed in the extension 282 and coupled to the housing 376. The rod 410 may be moved relative to the extension 282 to move the latch 342 relative to the housing 376. For example, a force may be imparted to move the rod 410 in the second vertical direction 218 to move the housing 376 in the second vertical direction 218 and compress the biasing member 386. As a result, the latch 342 may rotate in a first rotational direction 412 about the pivot 377 relative to the housing 376, and may move the protrusion 370 toward the housing 376, such that the protrusion 370 no longer extends through the notch 374. As such, the latch 342 no longer blocks movement of the extension 282 relative to the receptacle 256, and the extension 282 may be removed from the receptacle 256 to decouple the movable barrier 280 from the receptacle 256. In one embodiment, the rod 410 is coupled to the knob 340, such that movement of the knob 340 in the second vertical direction 218 (e.g., by a user pressing down on the knob 340) moves the rod 410 in the second vertical direction 218. Thus, the user may manually decouple the extension 282 from the receptacle 256 via the knob 340.

If the force is no longer imparted on the rod 410, the biasing member 386 may be configured to expand and move the housing 376 and the rod 410 in the first vertical direction 216 relative to the extension 282. Thus, if the user no longer presses down on the knob 340, the biasing member 386 may drive the housing 376 in the first vertical direction 216 relative to the extensions 282. As such, the latch 342 may rotate in a second rotational direction 414 about the pivot 377 to move the protrusion 370 away from the housing 376 (e.g., through the opening 372). In other words, the biasing member 386 may maintain the position of the latch 342 to orient the protrusion 370 out of the extension 372.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction system, comprising:

a walkway;

a carrier disposed at a first side of the walkway, wherein the carrier is configured to translate relative to the walkway; and a barrier disposed at a second side of the walkway opposite the first side, wherein the barrier is removably coupled to the carrier, and translation of the carrier relative to the walkway transitions the barrier between a stowed configuration and a deployed configuration.

2. The attraction system of claim 1, comprising a rail positioned at the second side of the walkway, wherein the carrier is slidably coupled to the rail such that the carrier is able to translate along the rail to transition the barrier between the stowed configuration and the deployed configuration.

3. The attraction system of claim 1, comprising an additional barrier fixed to a first edge of the walkway, wherein the carrier is configured to move the barrier toward the additional barrier to the stowed configuration, and the carrier is configured to move the barrier away from the additional barrier to the deployed configuration.

4. The attraction system of claim 1, wherein the barrier comprises a rod extending along a length of the barrier, and the rod is movable relative to the barrier and to the walkway to transition into and out of an aperture formed in the walkway.

5. The attraction system of claim 4, wherein the walkway comprises a plurality of apertures including the aperture to allow the carrier to be translated along the walkway to align the rod with a selected aperture of the plurality of apertures, and the rod is insertable into the selected aperture of the plurality of apertures to secure a position of the barrier relative to the walkway.

6. The attraction system of claim 1, comprising a ride vehicle, wherein the barrier is configured to transition to the stowed configuration when the ride vehicle is positioned proximate to the walkway to form a clear path between the ride vehicle and the walkway.

7. A barrier for a walkway, the barrier comprising:

an extension having an opening;

a rod disposed within the extension and coupled to a housing; and a latch coupled to the housing and configured to extend through the opening, wherein the rod is configured to move relative to the extension to move the latch relative to the opening.

8. The barrier of claim 7, wherein the latch is rotatably coupled to the housing, the rod is configured to move in a first direction relative to the extension to rotate the latch in a first rotational direction toward the housing, and the rod is configured to move in a second direction opposite the first direction relative to the extension to rotate the latch in a second rotational direction away from the housing and toward the opening.

9. The barrier of claim 7, comprising a knob coupled to the rod, wherein the rod extends out of the extension and is adjustable relative to the extension to move the rod relative to the extension.

10. The barrier of claim 7, comprising a holder fixed to the extension, wherein the housing comprises a projection extending through the holder.

11. The barrier of claim 10, wherein the projection comprises a retainer in abutment with a first side of the holder, the projection comprises a biasing member in abutment with a second side of the holder opposite the first side, and the retainer and the biasing member are configured to maintain a position of the housing relative to the extension.

12. An attraction system, comprising:

a walkway;

a carrier configured to translate relative to the walkway, wherein the carrier comprises a receptacle; and a barrier comprising an extension configured to insert into the receptacle to removably couple the barrier to the carrier, wherein the barrier comprises a latch configured to extend through an opening of the extension, and the carrier is configured to translate relative to the walkway to transition the barrier between a stowed configuration and a deployed configuration.

13. The attraction system of claim 12, wherein the carrier is configured to translate toward an edge of the walkway to the deployed configuration, and the carrier is configured to translate away from the edge of the walkway to the stowed configuration.

14. The attraction system of claim 12, comprising an attachment fixed to the walkway, wherein the attachment has a slot, the carrier comprises a flange having a hole and configured to insert into the slot, and the attraction system comprises an insert configured to extend into the hole when the flange is inserted into the slot to maintain a position of the flange in the slot and thereby couple the carrier to the attachment.

15. The attraction system of claim 12, wherein the barrier comprises a rod configured to move relative to the barrier and to the walkway, and the walkway has an aperture adjacent to the edge and configured to receive the rod to block at least some movement of the barrier relative to the walkway.

16. The attraction system of claim 12, wherein the latch is configured to extend through the opening of the extension and a notch of the receptacle to block movement of the extension relative to the receptacle and to couple the barrier and the carrier to one another.

17. The attraction system of claim 16, wherein the barrier comprises a housing disposed within the extension, the latch is rotatably coupled to the housing, the housing is configured to move in a first direction relative to the extension to rotate the latch in a first rotational direction away from the housing and through the opening and the notch, and the housing is configured to move in a second direction relative to the extension opposite the first direction to rotate the latch in a second rotational direction toward the housing and out of the notch to enable the extension to move relative to the receptacle to decouple the barrier and the carrier from one another.

18. The attraction system of claim 17, wherein the barrier comprises a rod disposed within the extension and coupled to the housing, the barrier comprises a knob coupled to the rod and extending out of the extension, and the knob is configured to move relative to the extension to move the rod and the housing in the first direction or the second direction relative to the extension.

19. The attraction system of claim 12, wherein the walkway comprises an additional receptacle, and the extension of the barrier is configured to be inserted into the additional receptacle to removably couple the barrier to the additional receptacle.

20. The attraction system of claim 12, wherein the walkway is an elevated walkway, the attraction system comprises a lower walkway and a rail disposed between the elevated walkway and the lower walkway, and the carrier is configured to be coupled to the rail between the elevated walkway and the lower walkway.

* * * * *